United States Patent [19]

Guiraud

[11] 4,087,995

[45] May 9, 1978

[54] COMBINATION LOCK

[75] Inventor: François Guiraud, Chambourcy, France

[73] Assignee: Fichet-Bauche, Velizy, France

[21] Appl. No.: 633,050

[22] Filed: Nov. 18, 1975

[30] Foreign Application Priority Data

| | | |
|---|---|---|
| Nov. 26, 1974 | France | 74 38742 |
| Oct. 20, 1975 | France | 75 32044 |

[51] Int. Cl.[2] ..... E05B 37/00

[52] U.S. Cl. ..... 70/299; 70/313; 70/315

[58] Field of Search ..... 70/315, 316, 321, 322, 70/311, 297, 298, 299, 313, 317, 318, 329, 333 R, 287, 288

[56] References Cited

U.S. PATENT DOCUMENTS

| | | | |
|---|---|---|---|
| 551,296 | 12/1895 | Tatum | 70/299 |
| 567,146 | 9/1896 | Lockwood | 70/313 |
| 3,176,486 | 4/1965 | Richardson | 70/333 R |
| 3,196,643 | 7/1965 | Moss | 70/317 |

*Primary Examiner*—Robert L. Wolfe
*Assistant Examiner*—Kenneth J. Dorner
*Attorney, Agent, or Firm*—Pollock, Vande Sande & Priddy

[57] ABSTRACT

A combination lock intended to equip a door of a safe, chest or strong room is disclosed in which both the setting up of the opening combination and the control of said opening are obtained using a single operating member.

It comprises:

(i) a multiplicity of ward-toothed wheel couples, each ward having a rack-gear with which co-operates the associated wheel adapted to be driven into rotation by the operating member;

(ii) catches of the same number as that of the wards and integral with a rake the motion of which, controlled by the operating member is only possible after the setting up of the combination;

(iii) bolt blocking means, integral with the rake and adapted to co-operate with a bearing of the tail of the bolt in order to allow or prevent the latter's sliding motion; and (iv) a bolt driving mechanism which carries actuating means for a device intended to jam the combination.

32 Claims, 39 Drawing Figures

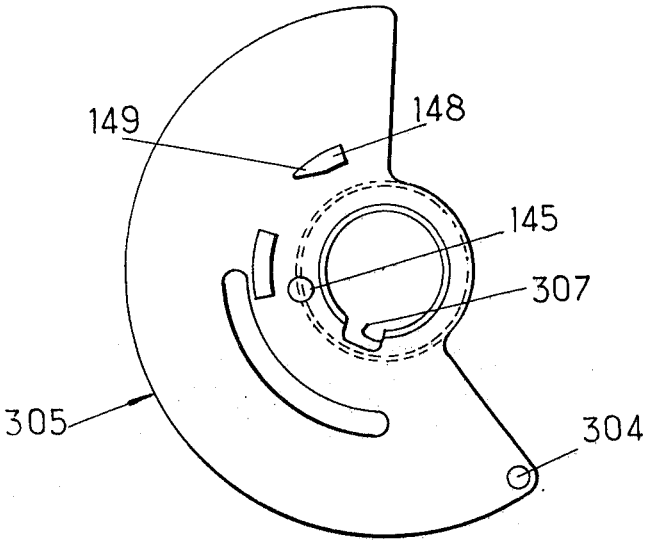
Fig. 30
Fig. 31
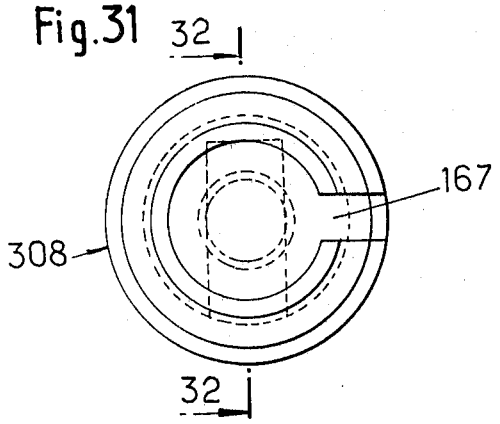
Fig. 32
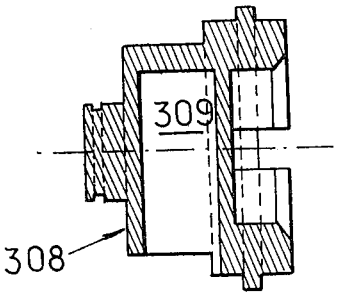
Fig. 33
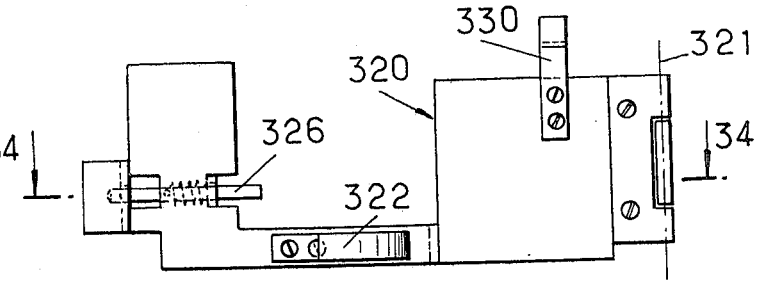
Fig. 34
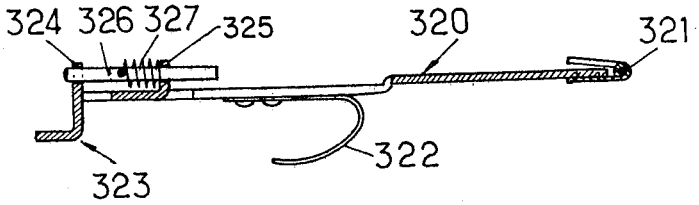

COMBINATION LOCK

BACKGROUND OF THE INVENTION

This invention relates to a combination lock.

Applicant has already proposed, in a combination lock designed to equip a safe, chest or strong room, in which both the display of the opening combination and the control of the opening are obtained using a single actuating member so that the wall of the safe, chest or strong room has only one passage provided for said member and, as a result, is not unduly weakened.

In this known lock, the setting up of the opening combination is effected through positioning of catch registers and, as a result, the display of the opening combination is not "silent."

Such an arrangement, although it may have advantages, for example, in that it allows operation in the dark, has, nevertheless disadvantages connected with the "noise" inherent to the display of the opening combination.

OBJECTS OF THE INVENTION

One of the objects of the invention is to provide a combination lock which may be operated using a single member, which makes it possible to obtain as many combinations, if not more, as multiple control locks and which does not have the disadvantage mentioned above.

Another object of the invention is also to provide an easy to use lock which, in addition, is entirely silent, i.e., in which the display of the opening combination depends only on the reading of numbers or letters, without the use of any "sonic indices."

Still another object of the invention is to provide such a highly safe lock in which, in particular, the combination cannot be found or detected and, which, in addition can resist attempts of fraudulent openings to which it might be subjected.

SUMMARY OF THE INVENTION

A combination lock according to the invention designed to equip a door of a safe, chest or strong room and in which both the setting up of the opening combination and the control of said opening are obtained using a single actuating member, is characterized in that it comprises:

a multiplicity of ward toothed wheel couples, each ward having a rack gear with which co-operates the associated wheel which may be driven into rotation by said actuating member;

catches in the same number as the wards and integral with a rake the motion of which, controlled by said actuating member, is only possible after the setting up of the combination;

blocking means integral with the rake and adapted to co-operate with a bearing of the bolt tail so as to allow or prevent the latter's sliding motion; and a bolt driving mechanism carrying means for actuating a combination jamming device, the motion of said mechanism being allowed only after the motion of the rake.

Each ward is friction mounted in a fixed guiding and maintenance assembly for the wards as a whole and this characteristic leads to a lock in which the combination cannot be detected through touch or noise, by a burglar.

According to another characteristic of the invention, a disengageable coupling between the actuating member and the bolt driving mechanism is provided.

Such a coupling, operative to allow the driving of the bolt by the single actuating member after the opening combination has been set up becomes, however, inoperative through disengagement, when the combination has not been set up, and in case of actuating by force of the bolt driving mechanism, in order to prevent deterioration of the lock.

According to still another characteristic of the invention, the lock is provided with a means designed to oppose its opening as a result of a fraudulent attack of the bolt following destruction or attempt of destruction of the blocking means, and said means, sometimes designated as a "detector" consists of a plate mounted pivotely in the case of the lock, said plate being subjected to the action of elastic means which tend to maintain it in its inoperative condition allowing the motion of the bolt, whereas it prevents any motion of the bolt when it is placed and maintained automatically in an operative condition by a tool attacking the blocking means or the lock mechanisms.

BRIEF DESCRIPTION OF THE INVENTION

The invention will be best understood by the following description whicn is given by way of example and with reference to the appended drawings in which:

FIG. 30 is a front view of the operating plate for the lock shown in FIGS. 27 to 29;

FIG. 31 is a front view of the plate driving socket;

FIG. 32 is a sectional view along line 32—32 of FIG. 31;

FIG. 33 is a front view of a detector;

FIG. 34 is a sectional view along 34—34 of FIG. 33;

DETAILED DESCRIPTION OF THE PREFERRED EMBODIMENTS

A combination lock according to the invention, 10, comprises, in a first embodiment, FIGS. 1 to 26, a case 11 shaped with a bottom 12 and lateral walls 13, 14, 15 and 16, each pierced at its ends with threaded holes as 17 and 18 for the attachment, using screw, as 19 and 20, of a cap 21 in which is provided a circular opening 21*a*.

Figure 5:
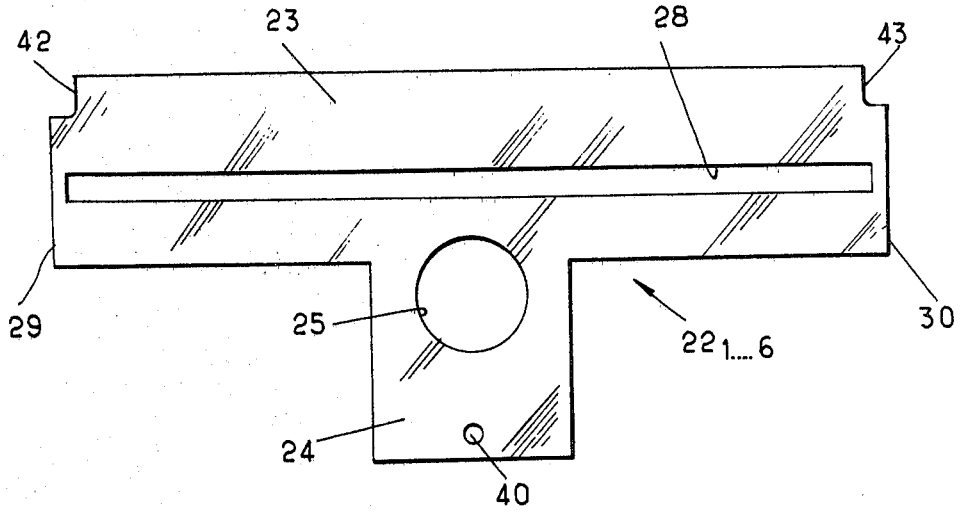
FIG. 5 is a plan view of a small plate of a fixed assembly of the lock.
Figure 5A:
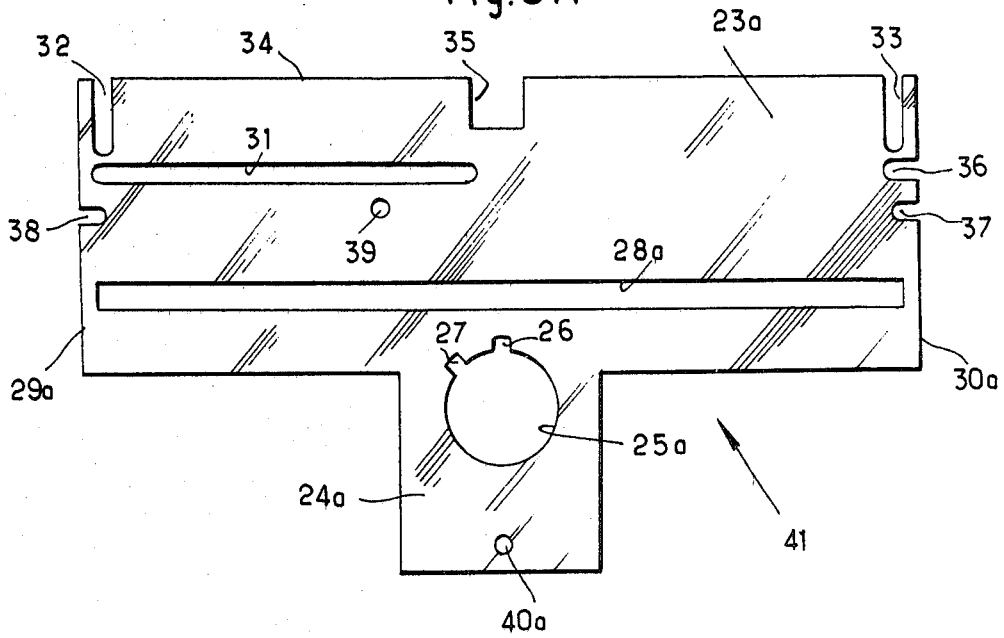
FIG. 5A is a view similar to that of FIG. 5, but for a small end plate.
Figure 6:
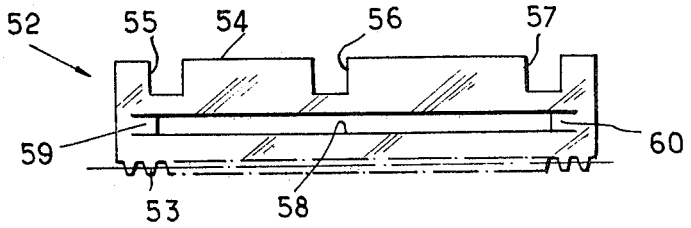
FIG. 6 is a plan view of a ward.
Figure 7:
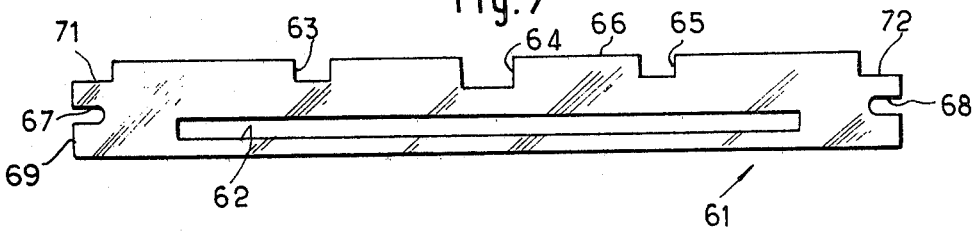
FIG. 7 is a plan view of a small plate in a rake.
Figure 8:
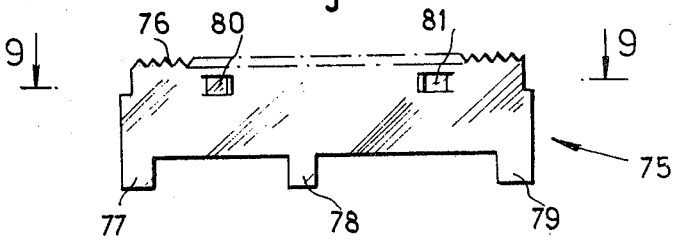
FIG. 8 is a plan view of a catch.
Figure 9:
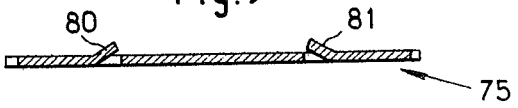
FIG. 9 is a sectional view along line 9—9 of FIG. 8.

On the bottom 12 of case 11 —which has holes 12*a* for the attachment of the lock onto a safe or similar equipment—is mounted a stack of plates $22_1$, $22_2$, . . . $22_6$ the shape of which is as shown in FIG. 5, i.e. comprises a head 23 which is substantially rectangular and from which depends a lug 24 which is pierced with a circular hole 25. In addition, each plate 22 is pierced with a rectangular stud-hole or slot 28 running on almost the entire length of head 23 between the opposite small sized edges 29 and 30 of said head. The stack of plates $22_1$ . . . $22_6$ is topped by a plate 41 the shape of which is as shown in FIG. 5A, i.e., comprises a head 23*a* which is substantially rectangular on which depends a lug 24*a* pierced with a hole 25*a* which is generally circular comprising, however, two radial notches 26 and 27 making an angle between them of approximately 45°. In addition, plate 41 is pierced with a rectangular stud-hole 28*a* running over almost the entire length of head 23*a* between the opposite small sized edges 29*a* and 30*a* of said head. A shorter stud-hole 31 runs over somewhat less than half the length of head 23*a* from the neighborhood of edge 29*a*. On the longitudinal side 34 of head 23*a* opposite lug 24*a*, are two notches 32 and 33 which emerge, extending parallel to said side near edges 29*a* and 30*a*, as well as a median cutting 35 shaped approximately as a square. On edge 30*a* of head 23*a*, are two rounded bottom notches 36 and 37 which emerge whereas a notch 38, also having a rounded bottom, emerges on the edge 29*a* of the head 23*a* between stud-hole 28*a* and stud-hole 31. Circular holes 39 and 40*a* are provided, one in head 23*a* between stud-holes 28*a* and 31, and the other in lug 24*a* between hole 25*a* and the free edge of said lug. The position of hole 40*a* in plate 41 corresponds to that of a hole 40 provided in each of the plates $22_1$ . . . $22_6$.

Figure 1:
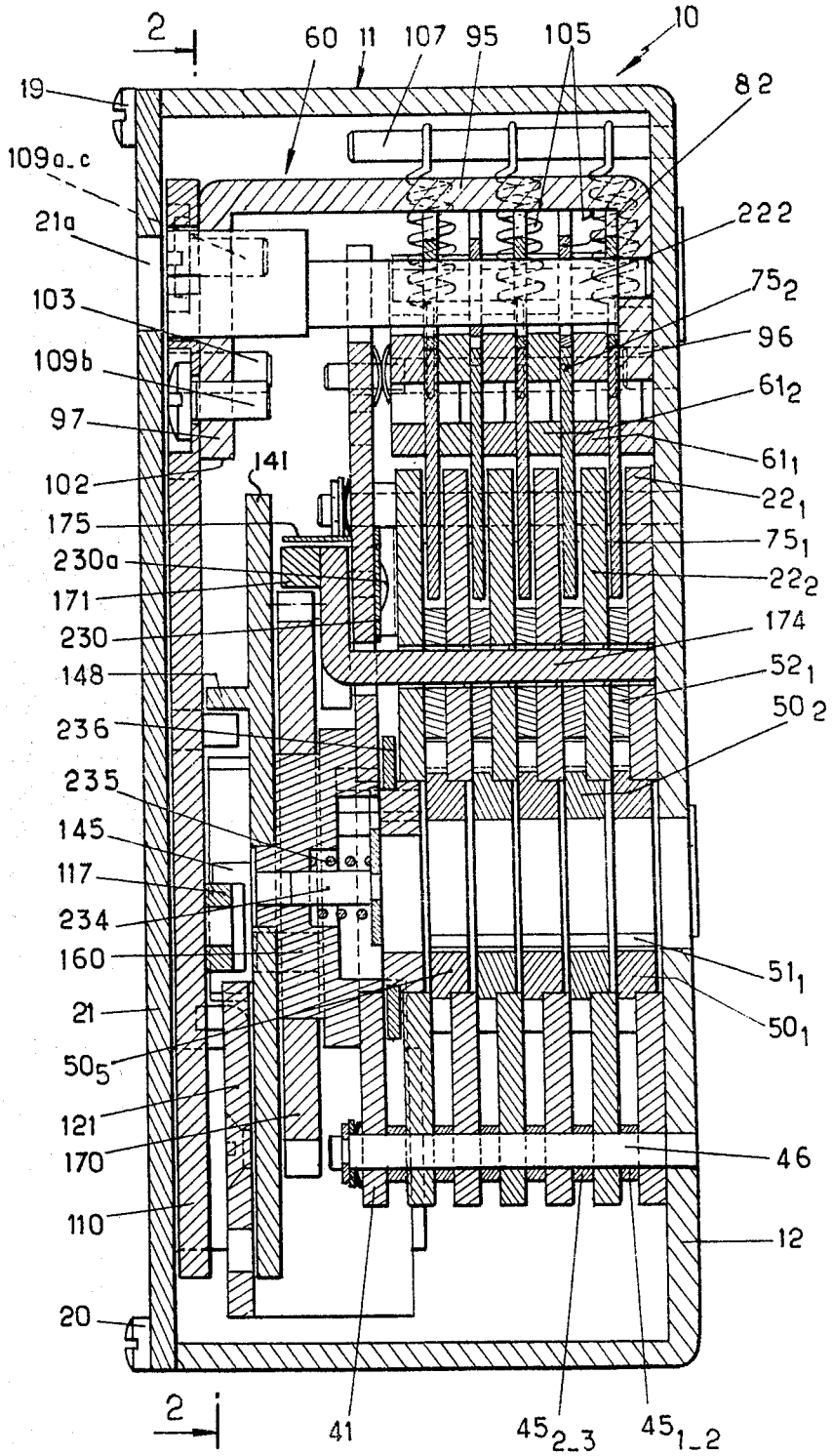
FIG. 1 is a longitudinal sectional view along line 1—1 of FIG. 2 of a combination lock according to the invention.
Figure 2:
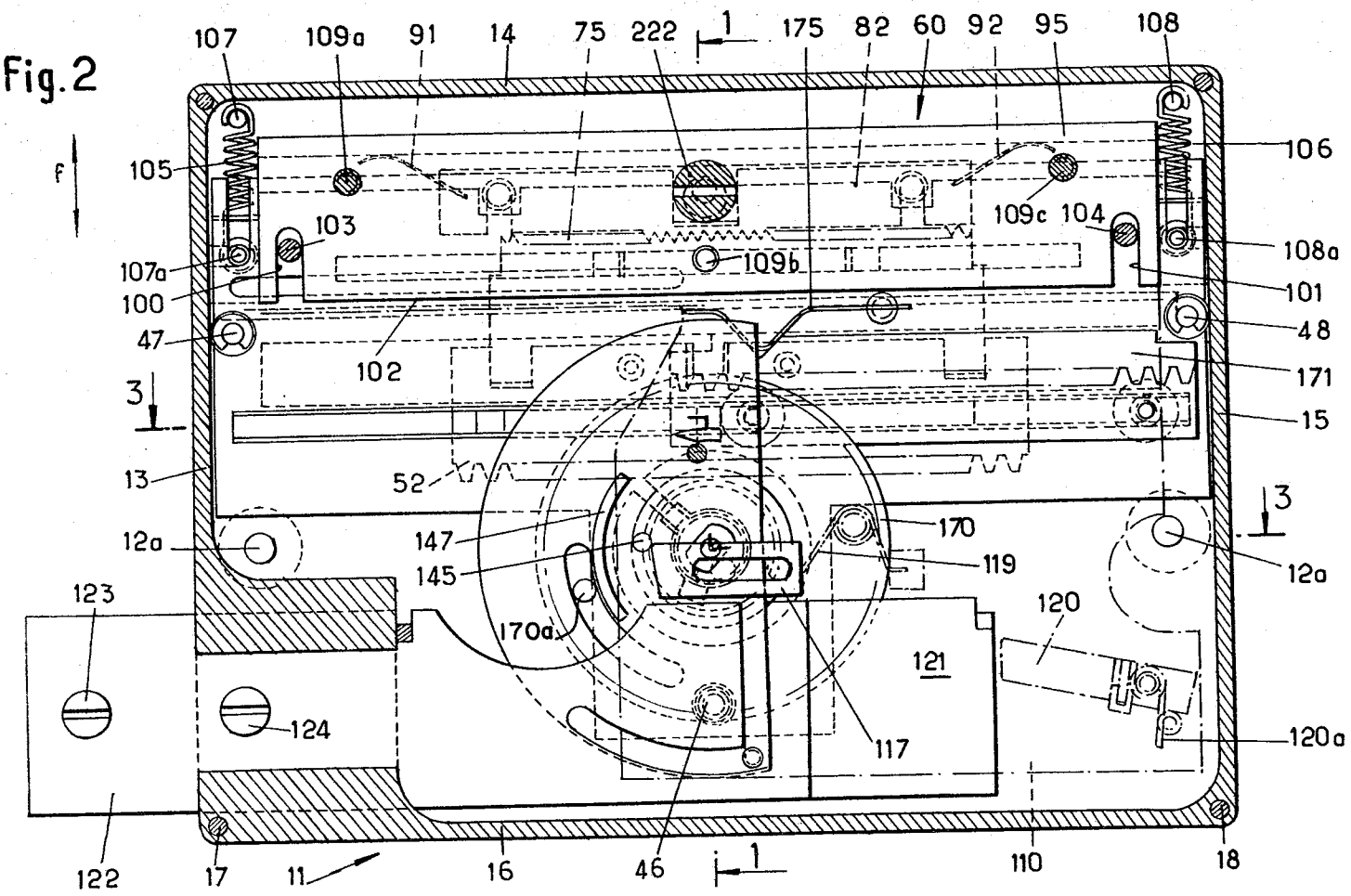
FIG. 2 is a sectional view along line 2—2 of FIG. 1.

The plates 22, 41 are maintained at a distance from one another by intercalated rings $45_{1,2}$, $45_{2,3}$, etc., FIG. 1, slipped onto a shaft 46 attached on the bottom 12, FIGS. 1 and 2, and crossing the plates 22 and plate 41 through holes 40 and hole 40*a*. Two other shafts 47 and 48, also attached on bottom 12, FIGS. 1 and 2, cross plate 41 through notches 37 and 38, while two angles of heads 23 of plates $22_1$ . . . $22_6$ are cut out as shown in 42 and 43 to allow passage of said shafts.

In holes 25 of plates $22_1$ to $22_5$ are housed wheels $50_1$, $50_2$ . . . $50_5$, FIGS. 1 and 3, each of which has a radial groove $51_1$, $51_2$, $51_5$ and a toothed crown $50_{1a}$, $50_{2a}$, $50_{5a}$ the thickness of which is equal to that of the intercalated rings 45. With each crown, meshes a ward 52, FIGS. 1, 2 and 6, consisting of a small plate generally shaped as a rectangle, comprising on one of its large-sized edges, a rack gear 53 and on its opposite edge 54, three notches with a square contour 55, 56 and 57. The small plate is pierced, parallel to its edge 54, along a rectangular stud-hole 58 which extends over substantially its entire length and both ends of which include outwardly extending slashes or tabs 59 and 60. The latter, which extend into stud-holes 28 of plates 22, function to guide the wards in translational motion with respect to said plates. The number of wards is equal to that of the wheels 50, i.e., five in the example shown, without this indication being in any way limiting.

With the assembly just defined, i.e., plates 22, 41, toothed wheels 50 and rack wards 52, co-operates a rake assembly 60, FIGS. 1 and 2. The latter comprises a stack of plates $61_1$, $61_2$, etc. . . . $61_5$, each of which has the shape shown in FIG. 7, i.e., a generally rectangular contour with an elongated stud-hole 62, notches with a rectangular contour 63, 64 and 65 emerging onto one of the longitudinal edges 66 of the small plate and notches with a rounded bottom 67 and 68 which emerge onto the small-sized edges 69 and 70 linked to the edge 66 through steps 71 and 72, respectively. The plates 61 are provided to maintain and guide between them catches $75_1$, $75_2$ . . . $75_5$, which are in the same number as that of wards 52 and are arranged in the same planes as the latter. Each catch 75, FIGS. 1, 2, 8 and 9 consists of a small plate the thickness of which is slightly less than that of a ward 52 and which is conformed onto a longitudinal edge along a rack gear 76, while the other longitudinal edge has lugs 77, 78 and 79 depending on it having the same relative positioning and the same size as notches 55, 56 and 57 of a ward 52 with which the catch is adapted to co-operate in a manner which will be described in detail below. Two outwardly extending slashes or tabs 80 and 81 project from the body of each catch 75 which extends into stud-holes 62 of plates 61 and contribute to the guiding of the catches with respect to said plates.

Figure 10:
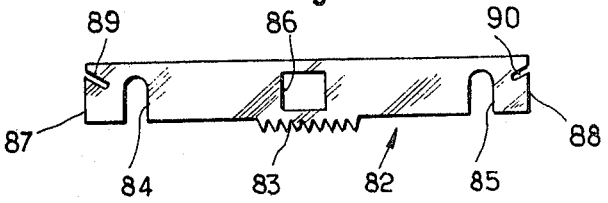
FIG. 10 is a plan view of a blocking strip.

With each of the catches, co-operates a blocking strip 82, FIGS. 1, 2 and 10 which, as will be seen later, also makes it possible to change the words, i.e., the opening combination and which consists of a small plate comprising a rack gear 83 on a central part of one of its longitudinal edges in which two indentations with a round bottom 84 and 85 emerge. A rectangular opening 86 is provided substantially at the center of the strip and on its faces limited by the small-sized edges 87 and 88, each strip has two saw-cuts 89 and 90 intended to receive, respectively, the ends of leaf-springs 91 and 92, FIG. 2.

Figure 11:
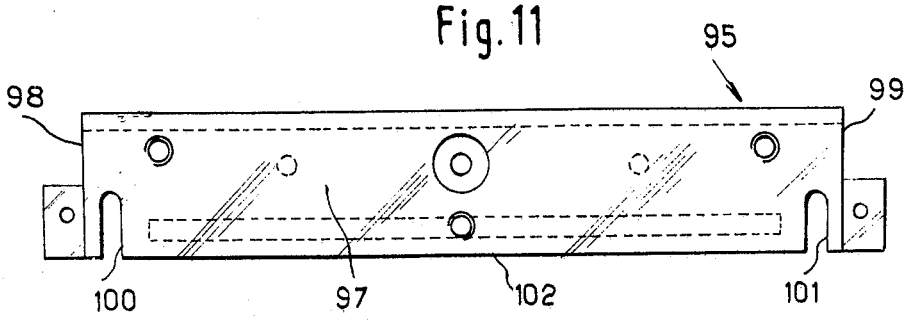
FIG. 11 is a front view of a body of a rake in a lock according to the invention.

The rake assembly 60 also comprises a rake body 95, FIGS. 1, 2 and 11, with a leg or U shaped cross section with a blade 96 adjacent to the bottom 12 of the case and a leg or blade 97 next to the cap 21, one and the other of said blades having near their cross-sectional edges shown at 98 and 99 for blade 97, laterally spaced slots or notches with a rounded bottom 100 and 101 emerging onto the longitudinal edge of the blade and which are provided for the translational guiding of the rake body, along the direction of the double arrow *f*, (see FIG. 2) through cooperation with two pairs of shafts like 103 and 104, one pair of which attached on the cap 21 is housed in the notches of blade 97 while the other pair, attached on the bottom 12 of the case, is housed in the notches of blade 96.

Return springs for the rake, shown at 105 and 106, are hooked onto shafts 107 and 108 attached to bottom 12 of the case and onto shafts 107*a* and 108*a* crossing plates 61 through their notches 67, 68 and attached to the blade 96 of the rake body.

Figure 12:
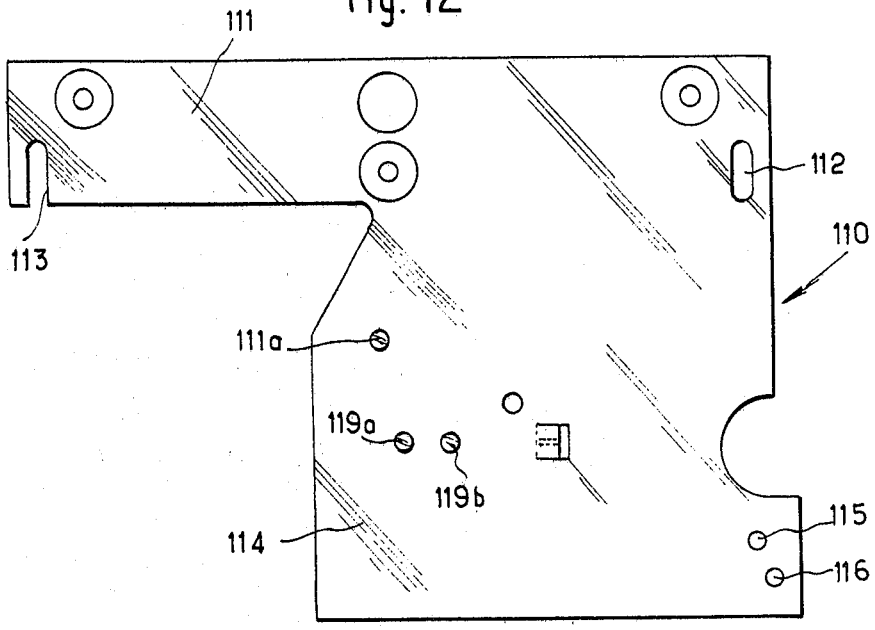
FIG. 12 is a plan view of the arm of the rake.

Blade 97 of the latter is integral through screws 109*a*, 109*b* and 109*c* with an arm of rake 110, FIGS. 1, 2 and 12, generally shaped as a right angle, one leg of which 111 has a stud-hole 112 and a notch with a rounded bottom 113 arranged in correspondence with notches 110 and 101 of the rake body and the other leg of which 114, bearing a pin 111*a*, is pierced in its lower right angle, in the drawing, with two circular holes 115 and 116.

Figure 12A:
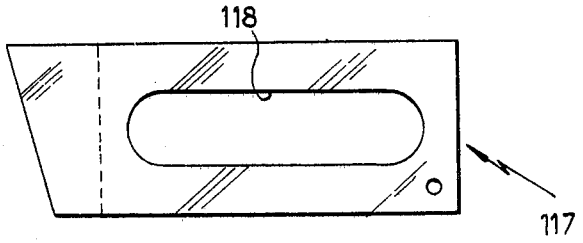
FIG. 12A is a front view of a rake operating click, but to a larger scale than that of the rake arm.
Figure 12B:
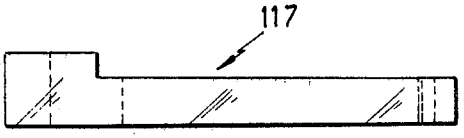
FIG. 12B is a top view of this rake operating click.

For the driving control of the rake, the arm 110 carries, in a manner which will be explained in detail below, a spring-biased, laterally movable cam or click 117 (FIGS. 12A and 12B), slidingly mounted on arm 10 through a longitudinal slot or stud-hole 118 in which are engaged pins 119*a*, 119*b*, attached to arm 110. On the click 117, is exerted the action of spring 119 which is also attached to the rake arm 110, as shown in FIG. 2.

Figure 13:
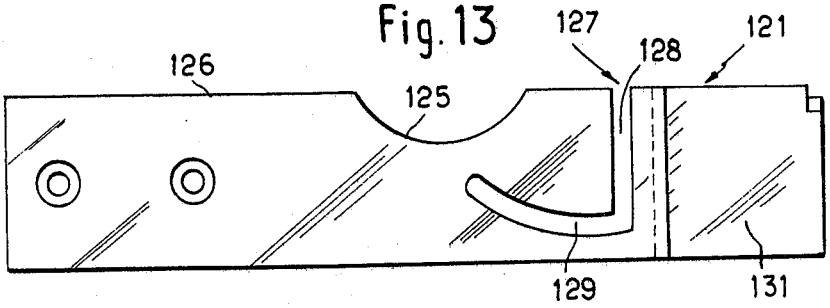
FIG. 13 is a front view of the bolt tail of a lock according to the invention.
Figure 14:
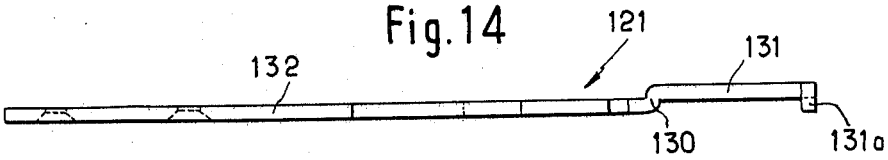
FIG. 14 is a top view of this bolt tail.

Hole 115 of the latter is used for the pivoting assembly of a blocking dog 120 (FIG. 2) subjected to the action of a spring 120*a* which urges it towards its blocking position and which is adapted to co-operate with a bolt tail 121, FIGS. 1, 2, 3, 13 and 14, on which is attached the bolt 122 through two screws 123 and 124. The bolt tail 121 is cut out as shown in FIG. 13, i.e., along an indentation shaped as an arc of a circle 125 on one of its longitudinal edges 126 and along a groove 127 one leg of which 128 is perpendicular to the edge 126 and emerges onto the latter, while the other leg 129, which is connected to the leg 128, is shaped as an arc of a circle centered on the axis of wheels 50 when the bolt tail is in position in the lock. In its part 131, distant from that carrying bolt 122, bolt tail 121 has a fold 130, so that this part 131, the end of which carries a bearing 131*a* perpendicular to it and with which co-operates the blocking dog 120, is in a plane parallel to that of part 132 carrying the bolt.

Figure 15:
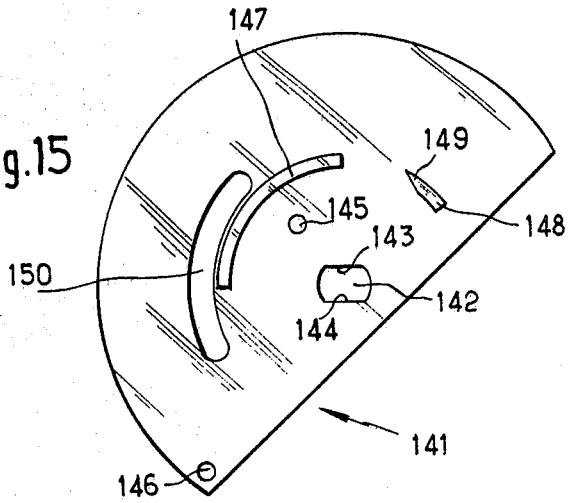
FIG. 15 is a front view of the lock operating plate.

For the purpose of operating the latter, the lock according to the invention comprises a plate 141, FIG. 15, shaped as a circular segment pierced centrally along an opening 142 comprising flat parts 143 and 144. Plate 141 carries a stub shaft 145 controlling the motion of the rake arm, adapted to co-operate with the click 117 and a stub shaft 146 intended to drive the bolt tail, housed in groove 127 of said tail. Plate 141 has, in addition, on its face carrying stub shafts 145 and 146, a rib shaped as an arc of a circle 147 with the same radius as that of indentation 125 of the bolt tail with which it is adapted to co-operate and a short rib 148 with a corner 149, having the same average radius as rib 147 and adapted to co-operate with the pin 111*a* of the rake arm. A stud-hole 150, with a larger radius than rib 147, is adjacent to the latter on a part of its length.

Figure 17A:
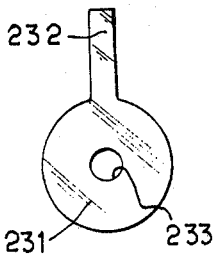
FIG. 17A is a front view of a blocking finger.
Figure 17:
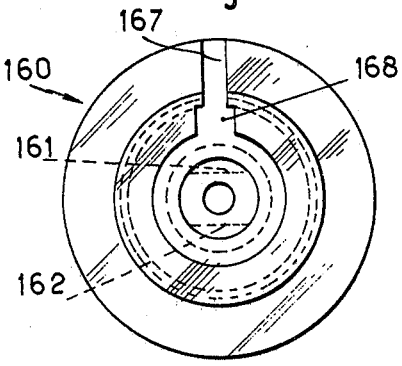
FIG. 17 is a view of the socket shown in FIG. 16 by arrow A of that figure.
Figure 16:
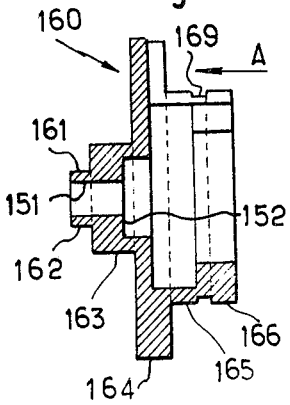
FIG. 16 is a longitudinal sectional view of the plate driving socket.
Figure 18:
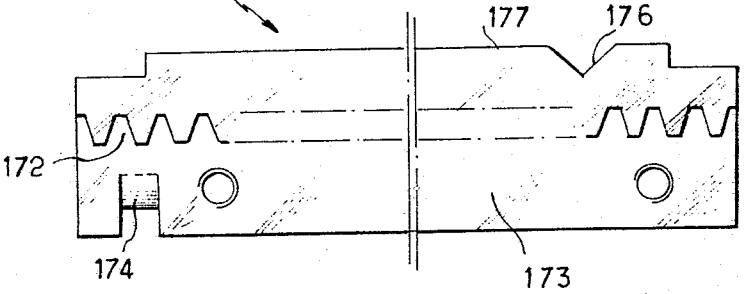
FIG. 18 is a front view of a jamming mechanism.
Figure 19:
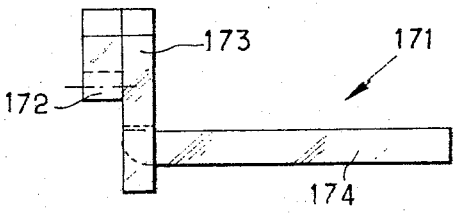
FIG. 19 is a side view of this jamming mechanism.

Plate 141 is carried by a socket 160, FIGS. 16 and 17, a front face of which has a bearing with two flat parts 161 and 162 conjugated with flat parts 143 and 144 of the opening 142 of plate 141. The socket 160 has, in addition, cylindrical bearings 163, 164, 165 and 166, the two latter housed, respectively in hole $25_6$ of plate $22_6$ and in the hole 25*a* of plate 41 of the fixed assembly, a radial groove 167 with an increased width in its part 168 corresponding to the bearing 166 running in front of said bearing, bearing 165 and a part of bearing 164. A peripheral groove 169 separates bearings 165 and 166. In addition, the socket is pierced, at right angles to the bearing with flat parts 161, 162 and to bearing 163, along a cylindrical bore 151 whose outlet, on the inside of socket 160 is at the level of a shoulder 152. The shape and sizes of groove 167 are conjugated with those of a blocking finger 232 projecting with respect to a disc 231, FIG. 17A, mounted by a central circular opening 233 which it presents on an axis axle 234 housed in the bore 151 of socket 160. On disc 231 is exerted the action of a spring 235 the end of which, distant from the disc, bears onto the shoulder 152 of socket 160. In the position shown in FIG. 1, disc 231 is bearing against a circlips 236, housed in groove 169.

Figure 3:
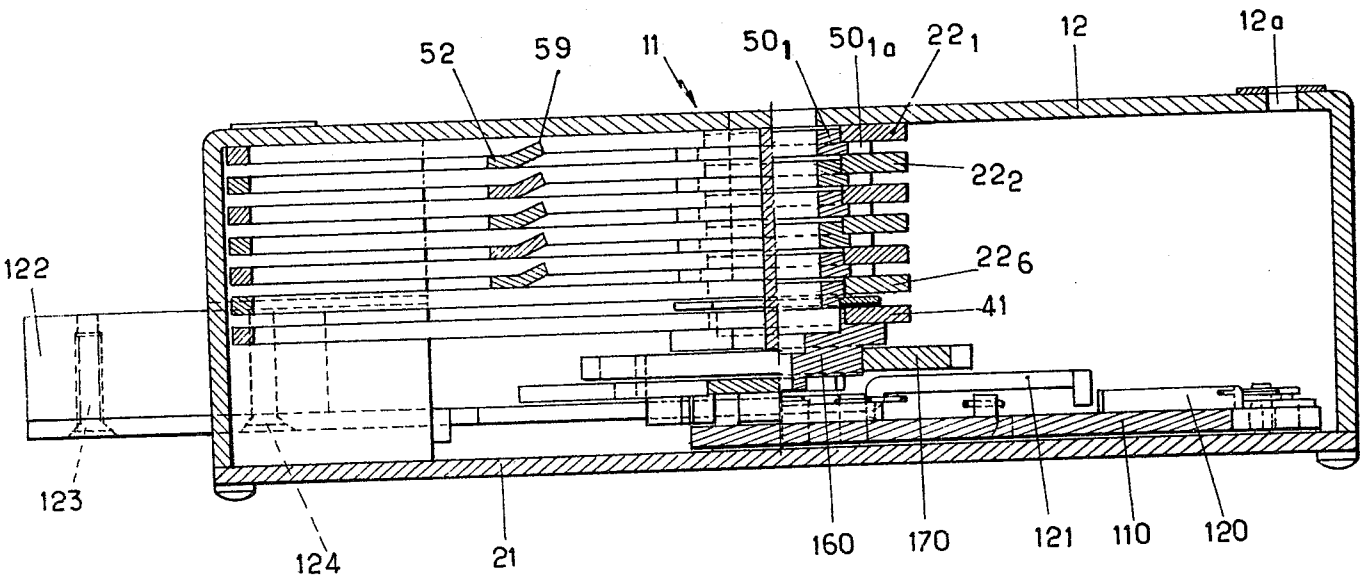
FIG. 3 is a sectional view along line 3—3 of FIG. 2.

On bearing 163 of socket 160 is mounted a toothed pinion 170, FIGS. 1, 2 and 3, from which projects a finger 170*a* housed in stud-hole 150 of plate 141. The toothed pinion is provided for the driving of a jamming device 171, FIGS. 1, 2 18 and 19, consisting of a rack gear 172, integral with a flat slab 173 from which there projects, perpendicularly to its plane, a bar 174 crossing the wards 52 through their stud-holes 58, the plates 22 through their stud-hole 28 and plate 41 through stud-hole 28*a*, the rack 172 co-operating with the teeth of pinion 170. The rack 172 is positioned through the action of a leaf spring 175, shaped as a V, housed in a notch 176 having a shape corresponding to the longitudinal edge 177 of flat slab 173.

Figure 4:
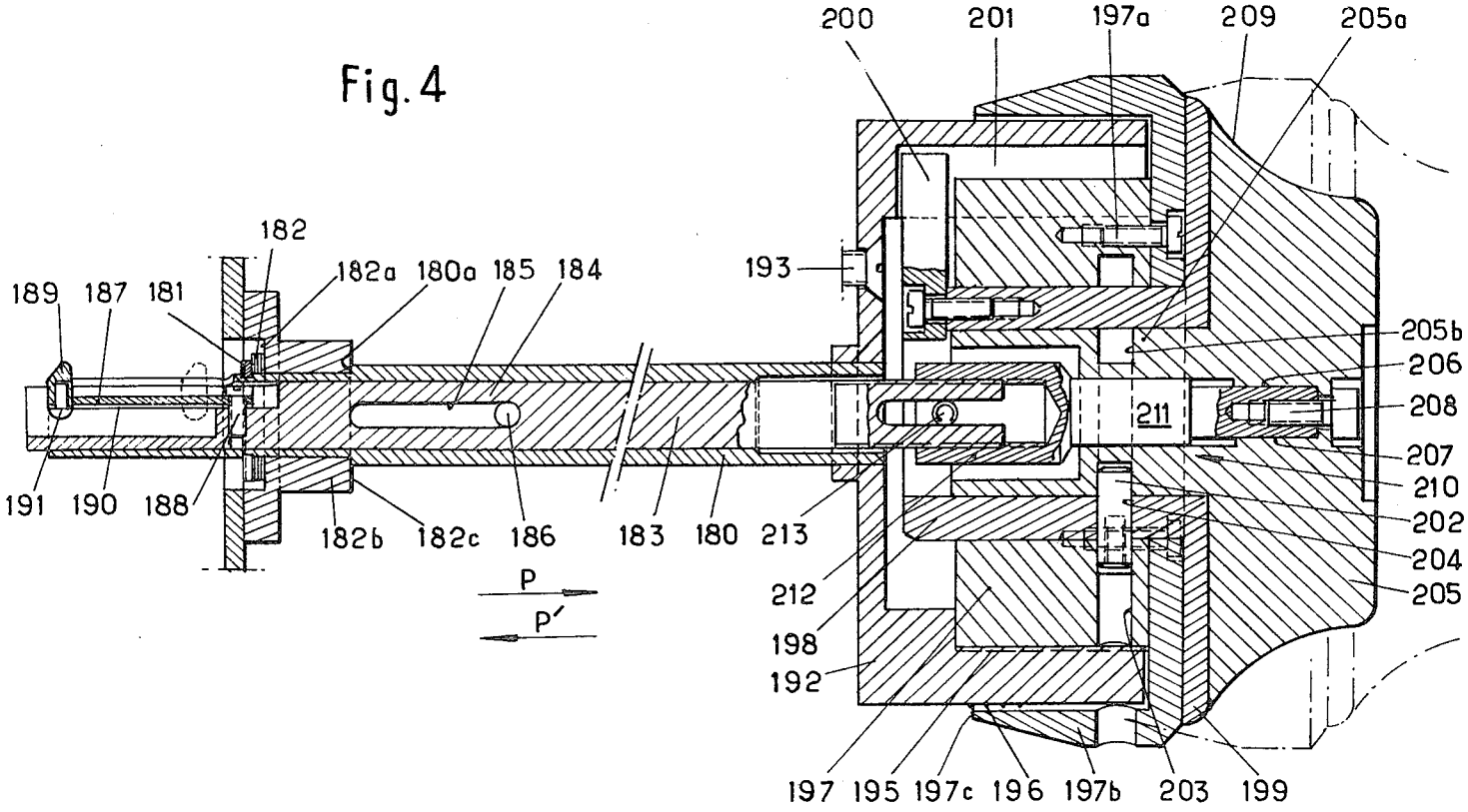
FIG. 4 is a view to a larger scale of the combination lock control and actuating means according to the invention.

The lock control assembly according to the invention is shown in FIG. 4. It comprises a tube 180 immobilized in translation with respect to the case of the lock in the direction of arrow *p*, through co-operation of a circlips 181 with a disc 182 bearing against face 182*a* of a barrel 182*b* of the case. Tube 180 which, in its part inside the lock case, has a shoulder 180*a*, is also immobilized in translation in the direction of arrow *p'* through co-operation of said shoulder with the front face 182*c*, parallel to face 182*a*, of the barrel 182*b*. Tube 180 can however be endowed with respect to the case, with a rotational motion around its axis 183. In the tube 180, is located a shaft 184 having a stud-hole 185, in which is housed a key 186, so that the shaft 184 is integral in rotation with the tube 180 but can be endowed with a translational motion with respect to the latter. A driving finger 189 mounted on a spring leaf 190 through a rivet 191 comprises the lock-actuating end of and is integral with the end part of shaft 184 housed in the lock case, through a counter-plate 187 and a screw 188. The finger 189 crosses the tube 180 through a slit provided in the latter and is provided to co-operate, in succession, with each of the wheels 50 and the socket 160 to drive them into rotation when it is engaged in the grooves 51 of said wheels and in the groove 168, its extreme positions being shown as a solid line and as a dashed line in FIG. 4.

At the end opposite that bearing the actuating finger 189, both shaft 184 and tube 180 penetrates into a cylindrical wheel-window 192 fixed by screws shown at 193 on the wall of the safe, strong room or similar equipment which the lock is intended to equip. The wheel-window 192 is threaded at 195 on the internal face of its longitudinal wall while, on its external face, said wall bears indices, as shown very schematically at 196, the role of which will be specified below and which are marked by the edge 197*c* of a selection knob button 197*b* overlapping the wheel-window 192 and integral through stud-holes 197*a* with a ring 197, threaded in correspondence with the threading 195 of the wheel-window 192 with which it co-operates.

Ring 197 receives a sleeve 198 having a flange 199 integral in rotation with wheel-window 192, but which is adapted to move with respect to the latter according to a translational motion guided by a key 200 housed in a groove 201 of the wheel-window. Ring 197 and sleeve 198 are made integral in translation along axis 183 of the control assembly through a pin 202 housed in a bore 203 of ring 197 and a bore 204 of sleeve 198. The control knob or button itself 205, which comprises a central shaft 205*a*, with a radial groove 205*b* in which is housed the pin 202, is integral with the shaft 184 through a part 210, the tail of which 211 carries two flat parts 206 and 207 and which extends in the direction of shaft 184, through a sleeve 212 tapped on the inside and integral in rotation with shaft 184 through a pin 213 with the end shaped as a U, threaded on the outside. The length of shaft 184 can thus, through screwing more or less the sleeve 212 on the end threading of the shaft, be set in correspondence with the exact thickness of the wall of the safe, which thickness can vary within certain manufacturing tolerance limits. A screw 208 contributes to the attachment of the shaft 184 extended by the part 210 with the actuating button 205 which carries on its lateral surface 209 numbers or letters designed to set up the opening combination.

Figure 20:
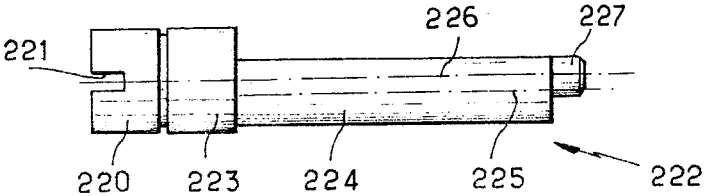
FIG. 20 is a front view of the word changing cam.

For the setting up and/or modification of the opening combination, the lock according to the invention is provided with a word changing cam, 222, the head of which 220 with a slit 221 for engaging a screw-driver blade may appear, as explained below, in front of the opening 21*a* of cap 21. As shown in FIG. 20, the word changing cam 222 comprises, after head 220, a cylindrical bearing 223 to which is attached a cylindrical part 224 having an axis 225, spaced from axis 226 of head 220 and of bearing 223, the cylindrical part 224 thus forming an eccentric between bearing 223 and an end pin 227 of the word changing cam through which said cam is mounted in rotation in blade 96 of the rake body 95. The word changing cam 222 crosses the blocking strips 82 through their openings 86 and, when said cam is caused to turn using a screw-driver blade introduced into the slit 221 of head 220, the eccentric which it provides raises the strips 82 which clear their rack gears 83 from the rack gears 76 of the catches 75, so that a combination can be set up or modified, as explained in detail hereinafter.

All of the components of the lock according to the invention, especially wards 52 and the toothed wheels 50, are maintained in a co-operating position through friction, under the action of a leaf-spring 230, attached through rivets 230*a* on plate 41, said spring bearing against plate $22_6$ which applies against the ward $52_5$ which is itself applied against plate $22_4$ . . . etc.

The operation of a combination lock according to the invention is as follows:

In order to open the lock, the combination which has been previously selected is first set up and the actual opening is then effected through actuation of the bolt.

(a) Setting up of the combination: In order to set up the opening combination, it is necessary to bring the notches 55, 56 and 57 of each of the wards 52 facing lugs 77, 78 and 79 of the catches 75 using wheels 50 driven into rotation by finger 189. In order to effect this, the selection button 197*b* is turned, which button drives into rotation the ring 197 leading to a sliding motion of the sleeve 198 which moves the actuating button 205 and shaft 184 which is integral with it in the direction of arrows *p* and *p'* until the edge 197*c* of the selection button comes opposite a first index 196 of the wheel-window 192 to indicate that the finger 189, which is then in the position shown as a dashed line in FIG. 4, is adapted to co-operate with wheel $50_1$. Taking into account the elastic assembling of finger 189 on the leaf spring 190, said finger can, during its translational motion, escape wheels 50 whatever the relative position of grooves 51 of said wheels and of the finger may be. Although it is certain, at the end of the translational motion of shaft 184, that finger 189 is in the plane of wheel $50_1$, it is not certain that finger 189 is housed in the groove $51_1$ of said wheel. In order to bring it there, the actuating button 205 is then turned until wheel $50_1$ can rotate no more, as a result of movement of ward $52_1$ into contact with a wall of the lock case. The rotation of wheel $50_1$ begins at the moment of introduction of finger 189 into groove $51_1$. From this position, further rotation of button 205, which brings a reference mark present on its lateral surface 209 opposite a fixed reference mark of flange 199, and thereby positions wheel $50_1$ in correspondence with the first number or letter of the opening combination, the motion of the toothed wheel $50_1$ during this phase of the rotation inducing a translation displacement of ward $52_1$, through its teeth $53_1$.

A new actuation of the selection button 197*b* then causes the translational motion of shaft 184 in order to bring finger 189 within the plane of wheel $50_2$, the satisfactory positioning being indicated by the reading of one of the indices 196. Actuation of button 205, identical with that defined above, i.e., first up to contact of ward $52_2$ with the case and then for the display of the second number or letter of the combination brings, through rotation of wheel $50_2$ and a translational motion of ward $52_2$, the notches 55, 56 and 57 of said ward facing lugs 77, 78, 79 of catch $75_2$.

After having actuated the rotation of each of the five wheels 50, in the embodiment described and shown, the opening combination is set up and the opening of the bolt can be effected.

(b) Opening of the bolt: It is obtained by driving into rotation socket 160 and plate 141 which is integral with it after the selection button 197*b* and button 205 have been again actuated in order to bring finger 189, through translational and rotational motion of axis 184, into notch 168 of socket 160.

As long as finger 189 has not penetrated into socket 160, spring 235 urges disc 231 in the direction of bottom 12 of the case and finger 232 of said disc is housed in notch 26 of plate 41. Socket 160 is thus immobilized in rotation and, the condition being that shown on FIG. 21, pin 146 is opposed to any translational motion of the tail of the bolt so that any fraudulent attempt of actuating the bolt is prevented.

When finger 189 is brought into socket 160, disc 231 is extracted from notch 26, displaced in the direction of the cap, against the action of spring 235 and the rotation of socket 160 is allowed. This rotation, which controls that of plate 141 in the direction of arrow *r* drives into rotation shaft 145 whose co-operation with click 117, on which is exerted the action of a spring 119, drives the rake arm 110 into a translational motion in the direction of arrow *s* shown on FIG. 21 and this until the lugs 77, 78 and 79 of the catches 75 penetrate into the notches 55, 56 and 57 of the wards 52.

Figure 22:
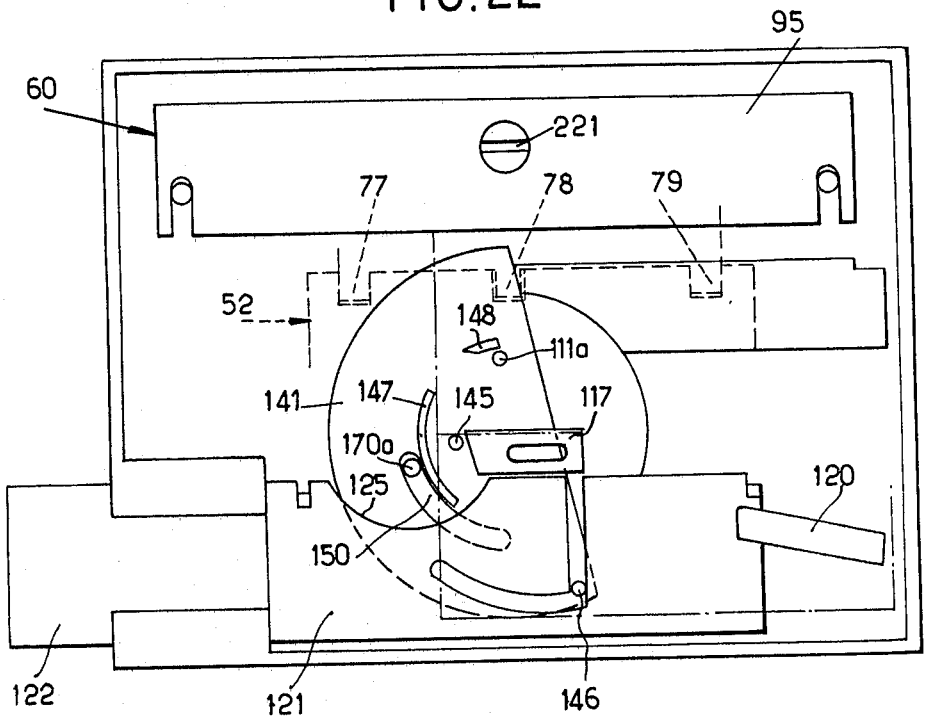

At the end of a first rotational phase of plate 141, when the shaft 145 escapes click 117, the condition is that shown on FIG. 22: because rib 148 co-operates then with pin 111*a*, rake 60 cannot be brought back to its initial position towards which it is urged by spring 105 and 106. During this first rotational phase of plate 141, shaft 146 moves in the arched part 129 of groove 127 of the bolt tail 121, without inducing any motion of the latter and this, until shaft 146 comes in front of leg 128 of said groove. Bearing 131*a* of the bolt tail is no longer facing the blocking dog 120, the latter having been induced to escape said bearing upon the translational motion along the direction of arrow *f* of the rake arm 110 on which it is mounted.

One end of rib 147 of plate 141 is close to the indentation 125 of the bolt tail which, however, it has not yet approached.

Figure 23:
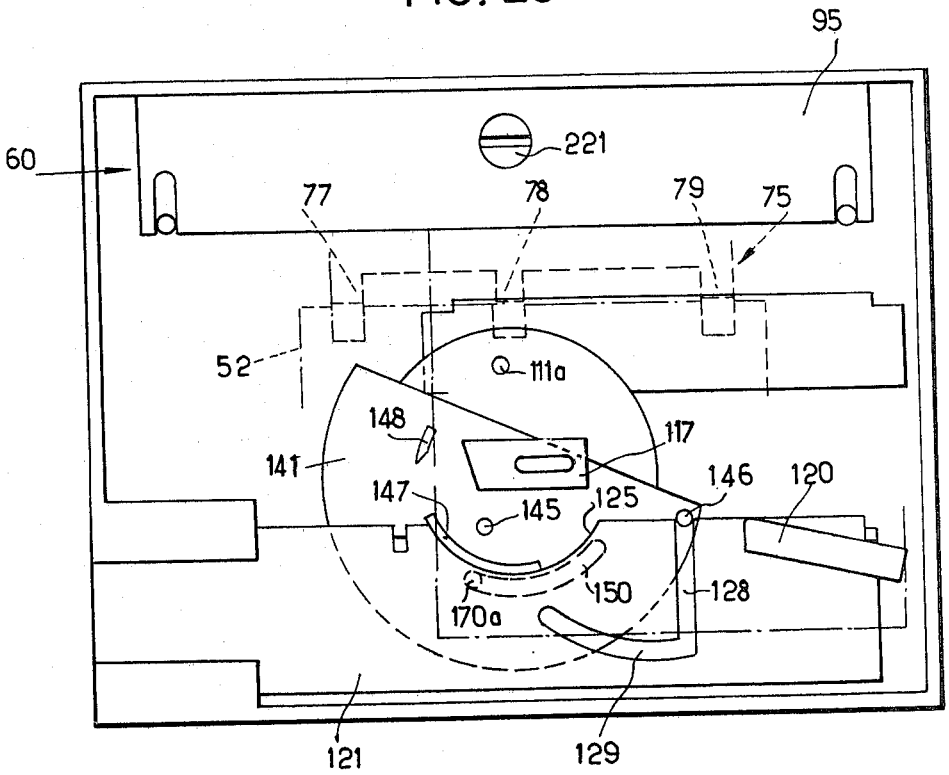
Figure 24:
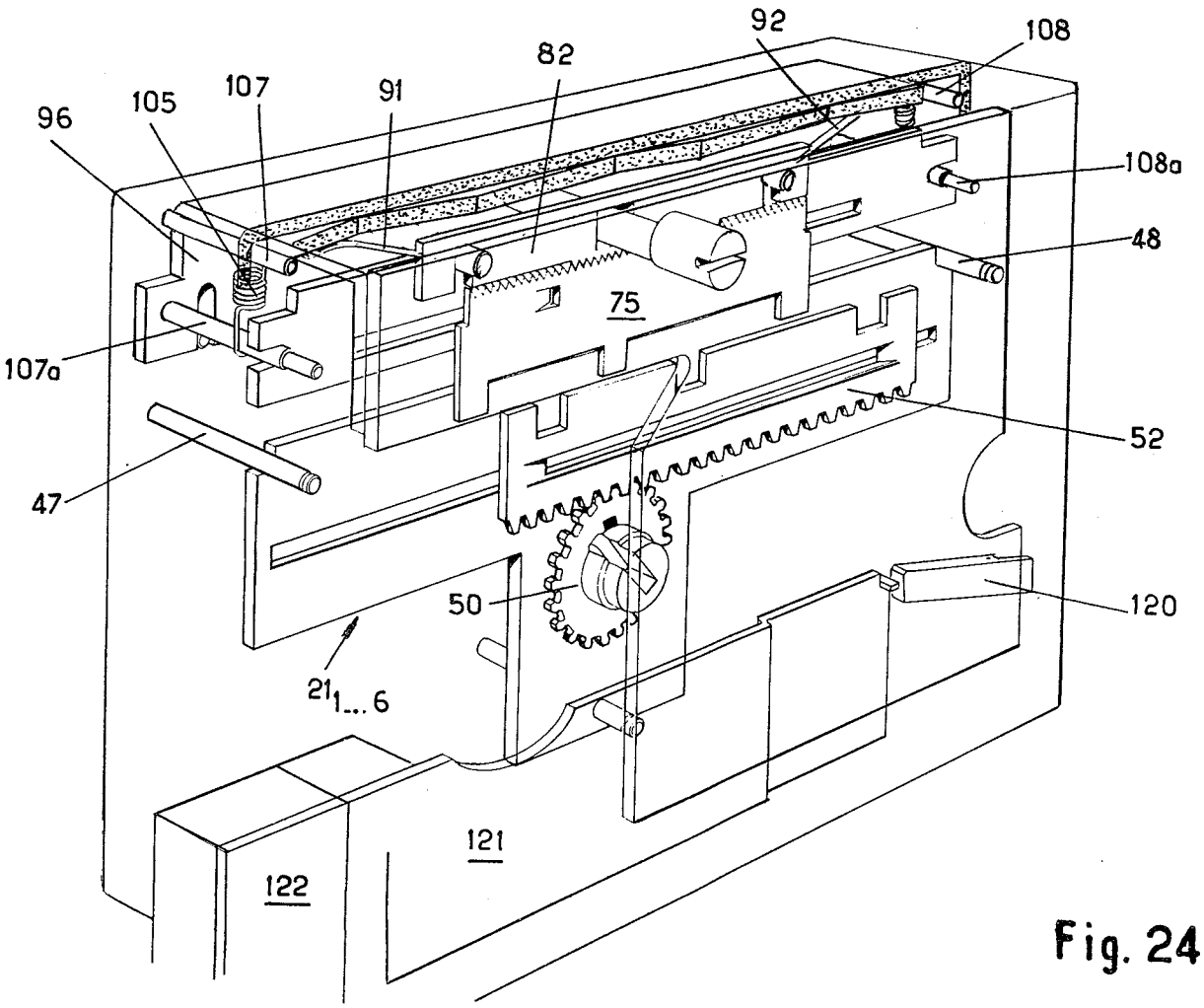
FIG. 24 is a partial, schematic and perspective view of a lock according to the invention under the condition shown in FIG. 21.
Figure 25:
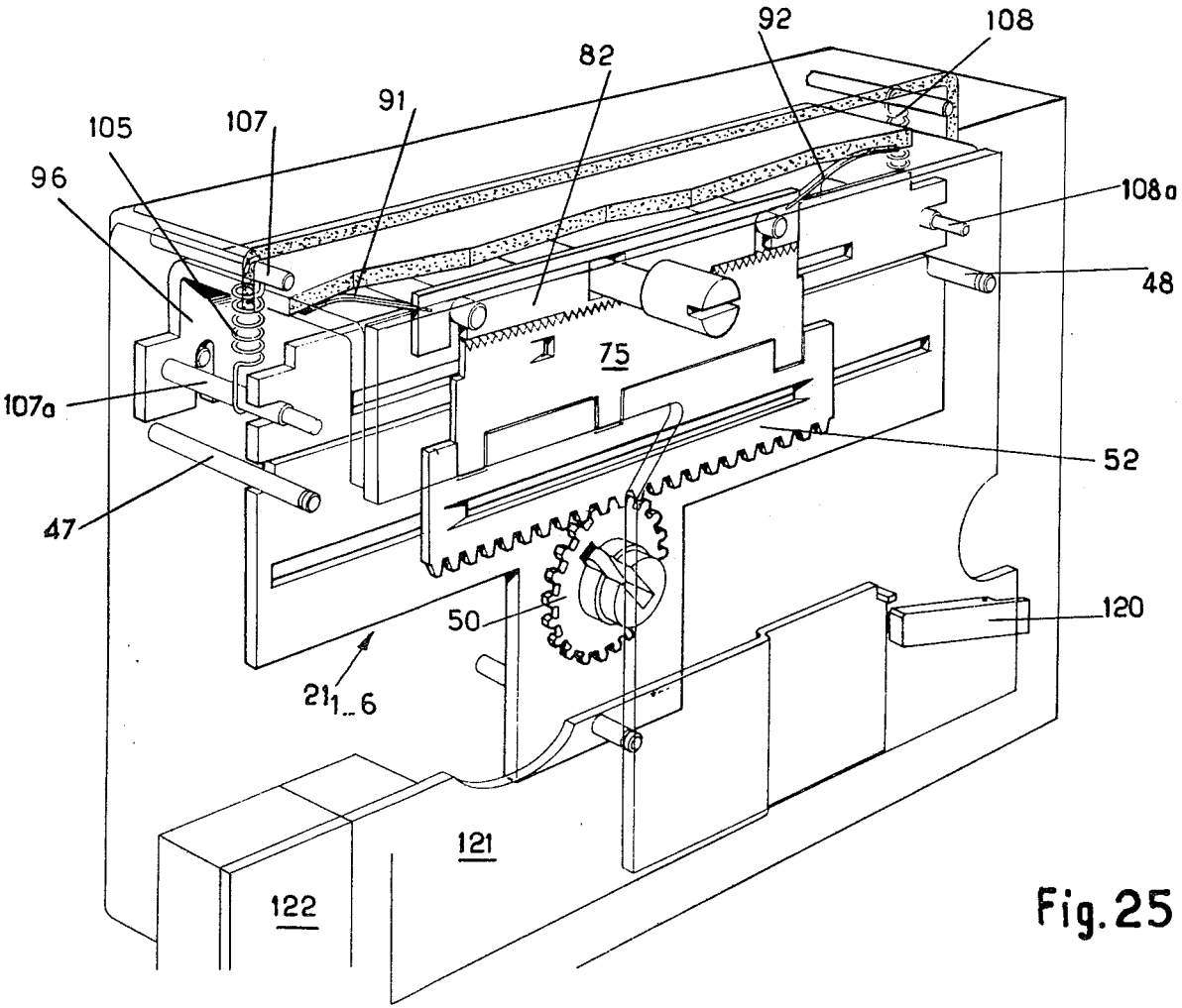
FIG. 25 is a partial, schematic and perspective view of a lock according to the invention under the condition shown in FIG. 22.
Figure 26:
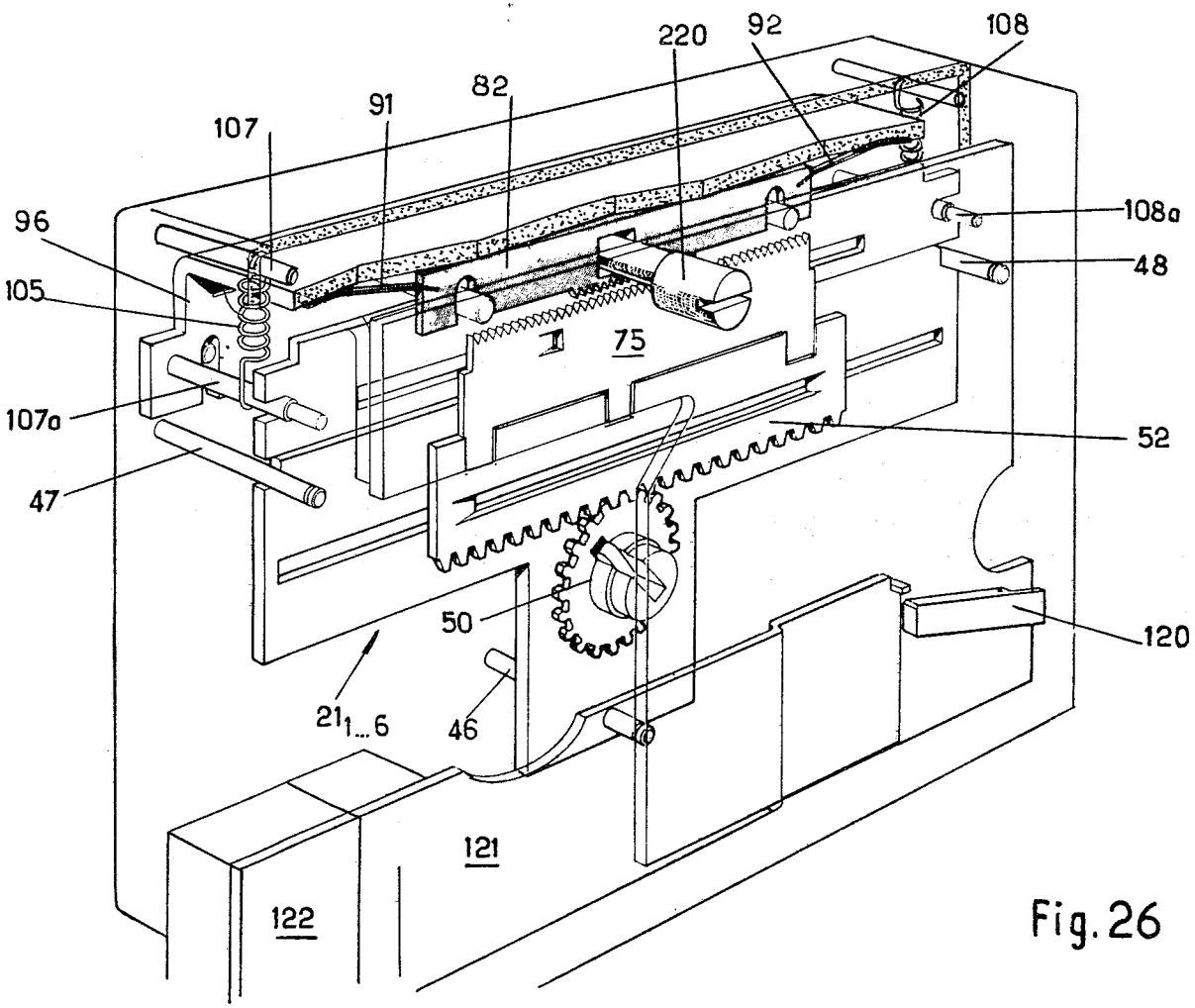
FIG. 26 is a view similar to the two preceding ones illustrating the position of the constituent parts of the lock upon changing of a combination.
Figure 27:
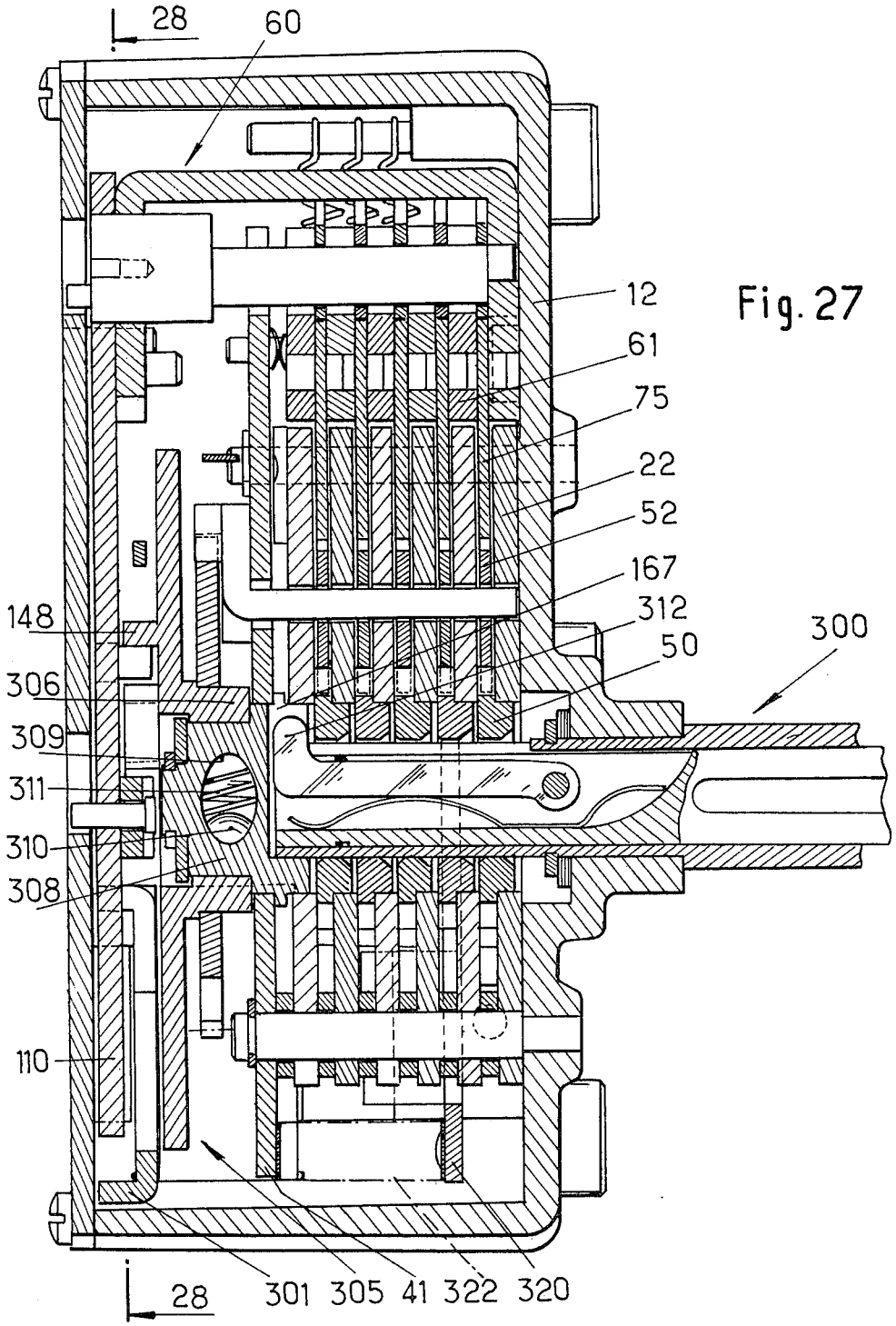
FIG. 27 is a sectional view along line 27—27 of FIG. 28 of a combination lock according to the invention, according to another embodiment.

When the rotation of button 205 is continued and, as a result, plate 141 is driven increasingly forward in its rotation along the direction of arrow *r*, shaft 146 co-operating with leg 128 of groove 127 of the bolt tail 121, drives the latter into translation, inducing the entry of the bolt and thus the opening of the lock. During the rotational phase which has just been described relating to plate 141, rib 148 of the latter escapes pawn 111*a*, so that rake 60, urged by springs 105 and 106, effects a translational motion in the direction opposite that shown by arrow *s* and which extracts the lugs 77, 78, 79 of catches 75 from notches 55, 56, 57, of wards 52, as shown in FIG. 23. Rib 147 of plate 141 having been brought into co-operation with indentation 125 of the bolt tail 121, the latter is maintained in the open condition even when shaft 146 escapes leg 128 of groove 127 at the end of the rotational motion of plate 141.

Figure 21:
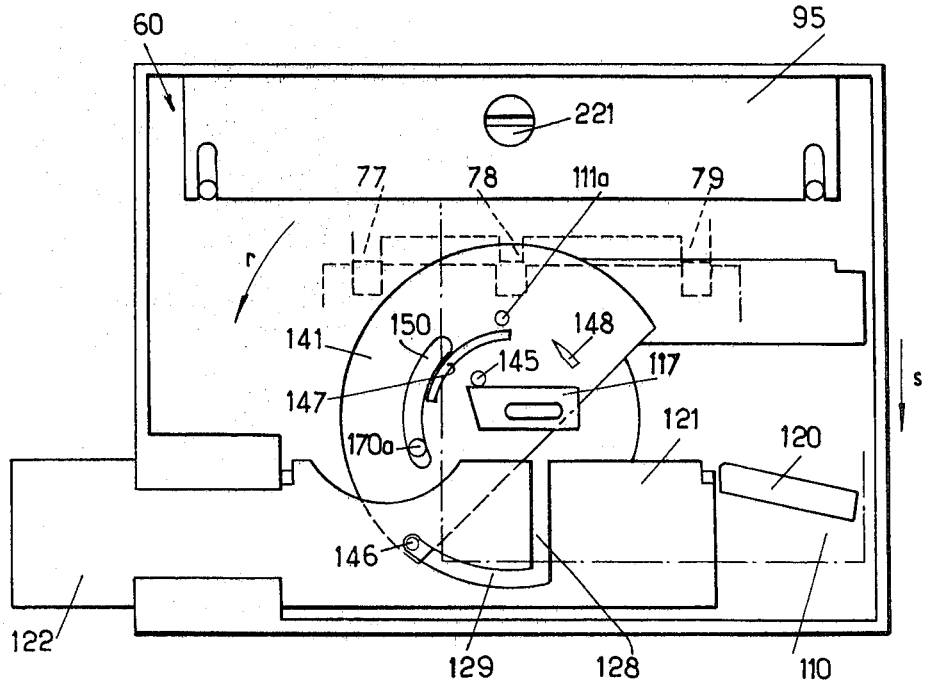
FIGS. 21, 22 and 23 are views similar to that of FIG. 2, but are more schematic and intended to illustrate the operation of a lock according to the invention.

During the first phase of this rotation, which causes the passage of plate 141 from its condition shown in FIG. 21 to that shown in FIG. 22, the stud-hole 150 leaves motionless the finger 170*a* attached on the jamming pinion 170. The teeth of the latter — which co-operate with the rack gear 172 urged by spring 175 — therefore remain stationary, the rotation of socket 160 not being transmitted to the jamming pinion 170 mounted on its cylindrical bearing 163.

However, as soon as rib 148 has escaped pawn 111*a*, i.e., as soon as rake 60 has taken up its initial position again under the action of springs 105 and 106, rotation of plate 141 induces the driving into rotation of the jamming pinion 170 through the bottom of stud-hole 150 co-operating with finger 170*a*; the rack gear 172 drives the jamming mechanism 171 along a translational motion and bar 174, which crosses the wards 52 through their stud-hole 58, drives into bearing said wards the rack teeth of which 53 control the rotation of wheels 50, with as a consequence, the cancellation of the combination which has been set up for the opening control of the lock.

When it is desired to close the lock again, the actuating button 205 is simply operated in reverse. When carrying out this rotation, the bolt 122 is first made to come out when shaft 146 co-operates with leg 128 of groove 127 of the bolt-tail and, simultaneously, finger 170*a* of the jamming pinion is brought back to its initial position for which bar 174 of the jamming mechanism is in the axis of wards 52, thus providing the certainty that, upon a new setting up of the combination for the subsequent opening of the lock, said bar 174 will not be opposed to the motion of wards 52 under the action of toothed wheels 50. During the rotation of plate 141 which corresponds to the closure of the lock, i.e., clockwise in the drawing, shaft 145 comes into contact with the bevelled face of click 117. The latter becomes eclipsed through a translational motion and against the action of spring 119 until, with the rotation of the plate continuing, shaft 145 turns back to the position shown in FIG. 21 liberating click 117 which, as a result, takes up again the position such that it allows a new opening actuation of the lock.

(c) Changing of the combination: It is effected when the door of the safe, strong room or similar equipment, which includes the lock according to the invention, is opened. The cap 21 is then visible. Through an operation similar to that effected for opening the lock, the components of the latter are brought to the condition shown in FIG. 22, i.e., the one in which the rack 60 has moved in order to bring lugs 77, 78 and 79 of catches 75 into the corresponding notches of wards 52. In that position, head 220 of the word changing cam 222 appears through the opening 21*a* of the cap. Through introduction of a screw-drive blade into slit 221 of the head 220, said cam is driven into rotation which cam, through its eccentric part 224, spreads apart the teeth 83 of the blocking strips 82 of teeth 76 of catches 75 and this, against the action of leaf-springs 91 and 92 housed in the saw-cuts 89 and 90 of said strips.

When the operating assembly —in which the finger 189 was engaged in the groove of socket 160 in order to control the rotation of plate 141 —is actuated in order to bring said finger 189 in the plane of the first of the wheels said finger 189 in the plane of the first of the wheels 50, finger 232 of the blocking disc 231 urged by spring 235, FIG. 1, penetrates into notch 27 of plate 41, preventing any rotational motion of socket 160 and, as a result, any motion of the rake 60. When finger 189 is in the plane of wheel $50_1$, a rotation of button 205 induces a rotation of said wheel which drives ward $52_1$ and catch $75_1$ which is integral with it into translation —lugs 77, 78, 79 being introduced into the corresponding notches 55, 56 and 57 — so that the user displays the first number or letter of the combination which he marks off on the lateral surface 209 of button 205. Through rotation of the selection button 197*b*, the shaft 184 is then moved in order to bring finger 189 within the plane of the toothed wheel $50_2$ adjacent to wheel $50_1$, a rotation up to bearing against button 205 providing the certainty that finger 189 will penetrate into the groove of said wheel which, placed into rotation through actuation of button 205, brings through ward $52_2$, which is then integral in translation, the catch $75_2$ into the new desired combination position, marked on the surface 209.

The operation is repeated until the setting up of the new combination. Actuation of the word changing cam 222, in reverse of that effected previously, liberates the action of springs 91 and 92 which return teeth 83 of blocking strips 82 into engagement with the teeth 76 of catches 75. The combination which has just been set up is thus set "into memory" in the lock.

The latter, in which the pre-established combination cannot be detected from the inside of the safe, strong room or similar equipment, provided with the lock, is thus very safe.

It is also convenient to use in that it makes it possible, in a simple manner, to palliate an error of the user upon displaying, with the door open, of a new combination. When, for example, after changing of a combination, the user tries the lock with the door open and it appears that he has made a mistake in the combination which he believed he had set up, it is not possible to know the combination but it is possible, by removing the cap 21 which gives access to the word changing cam 222, to actuate said cam. The blocking strips 82 of catches 75 are thus disconnected and using a screw-drive blade or similar device, all the catches are returned, through bearing at the end of a stroke, into the zero position. The blocking strips 82 are again made operative through actuation of the word changing cam and the cap is attached to the lock case. Using the operating button 205, the zero combination is displayed on all the wheels 50 which makes it possible to actuate rake 60 in order to bring it again to the condition shown in FIG. 22 from which a new operation of "memory insertion" of a combination is effected in the manner indicated above.

Reference is now made to FIGS. 27 to 35, relating to another embodiment and in which parts which are similar to those of the preceding embodiment have the same references.

In this embodiment, the single operating member for driving into rotation the toothed wheels 50 carries the reference 300 and the tail of the bolt carries the reference 301. The latter is cut out along an indentation 302, generally shaped as a U, and the edge of which 303 is adapted to be engaged by a shaft 304 of a plate 305 for actuating the tail of the bolt, FIGS. 27, 28 and 30. Plate 305, which also carries shaft 145 for controlling the motion of the rake arm 110 and the short rib 148 having a corner 149 adapted to co-operate with pin 111*a* of arm 110 of rake 60, constitutes a single part with a sleeve 306, FIG. 27, with a longitudinal groove 307. The sleeve is mounted on a socket 308, FIGS. 27, 31 and 32, which has the radial groove 167 and is pierced along a blind bore 309 extending perpendicularly to the rotational axis 310 of the socket and to the groove 167. The diameter of the blind bore 309 is substantially equal to the width of groove 307 of sleeve 306 and, in said bore, are housed a ball 310 and a spring 311, FIGS. 27 and 28.

Socket 308 is adapted to be driven into rotation when an actuating finger 312 of the operating member 300 is introduced into groove 167, after the combination has been set up using wheels 50. Upon a "normal" actuation of the lock, the disengageable coupling effected between socket 308 and plate 305 through bore 310, which is then partially housed in groove 307 under the action of spring 311, is operative to transmit the rotation of the socket to the plate and thus to control the sequence of operations described previously and which lead to the withdrawal of the bolt.

On the contrary, when the actuating finger 312 is introduced into groove 167 and the combination has not been set up, the rotation of the operating member tends to cause the rotation of the socket 308, but the rotation of plate 305 being prevented, a "forced" rotation of the socket causes ball 310 to escape from groove 307, by compressing spring 311, and the coupling between the plate and the socket is disengaged, so that the mechanisms of the lock cannot be damaged.

In addition to the protection provided by the disengageable coupling, the invention provides for the protection of the lock against a fraudulent attack of the bolt occurring after destruction or an attempt of destruction of its blocking means or its mechanisms.

Figure 28:
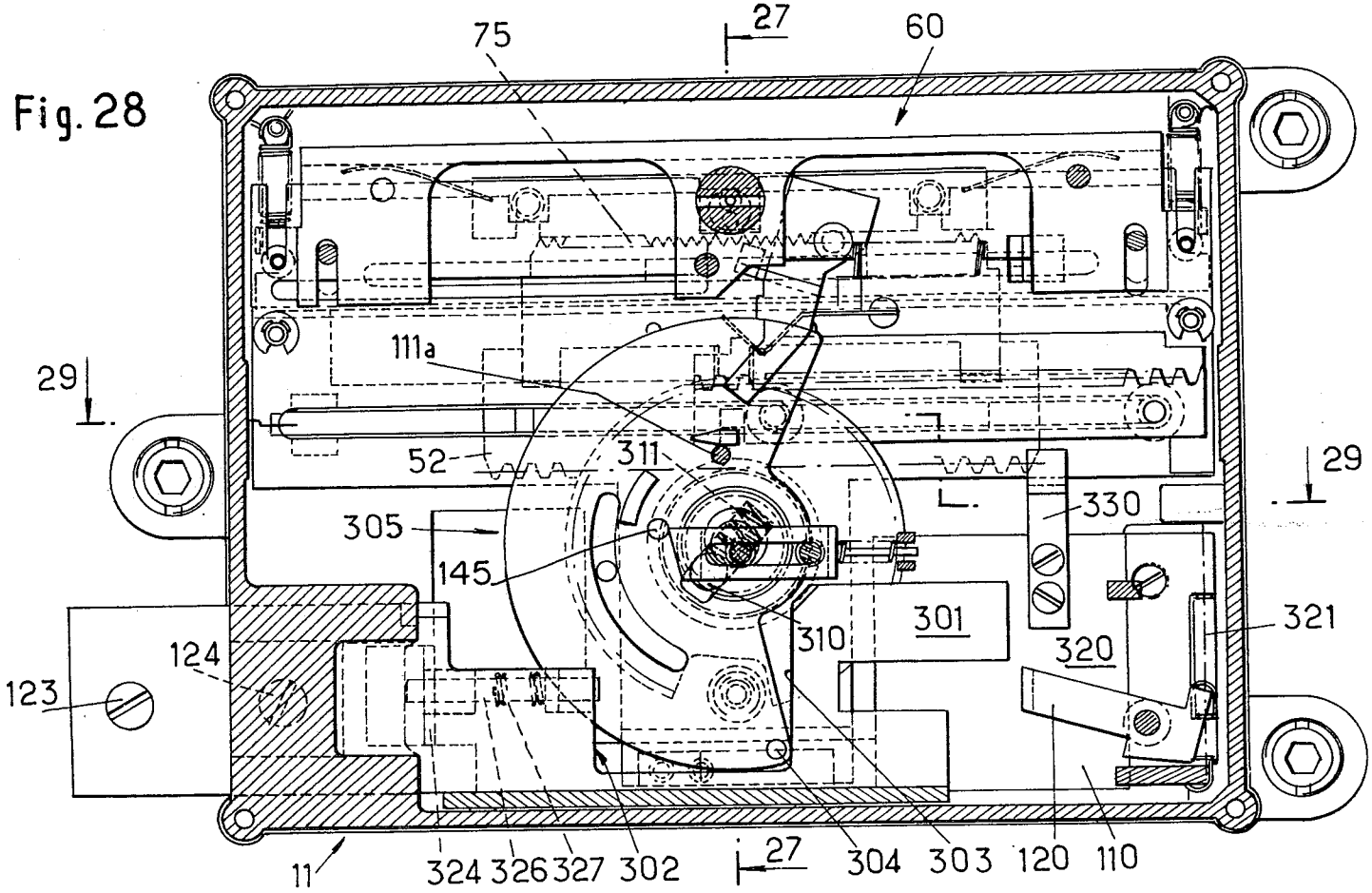
FIG. 28 is a sectional view along line 28—28 of FIG. 27.
Figure 29:
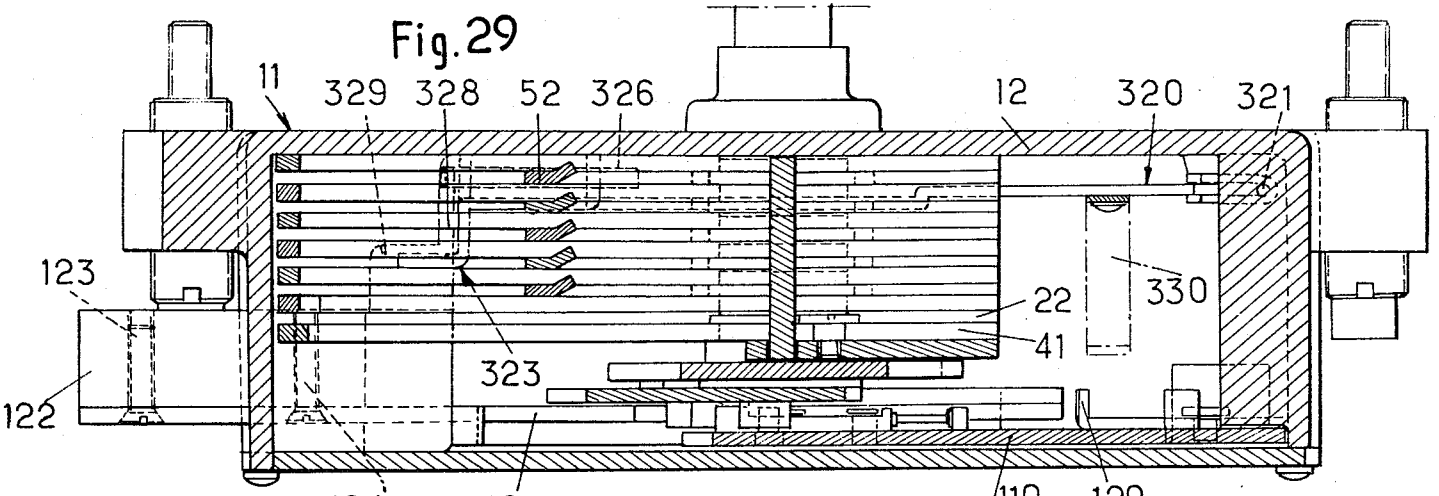
FIG. 29 is a sectional view along line 29—29 of FIG. 28.
Figure 35:
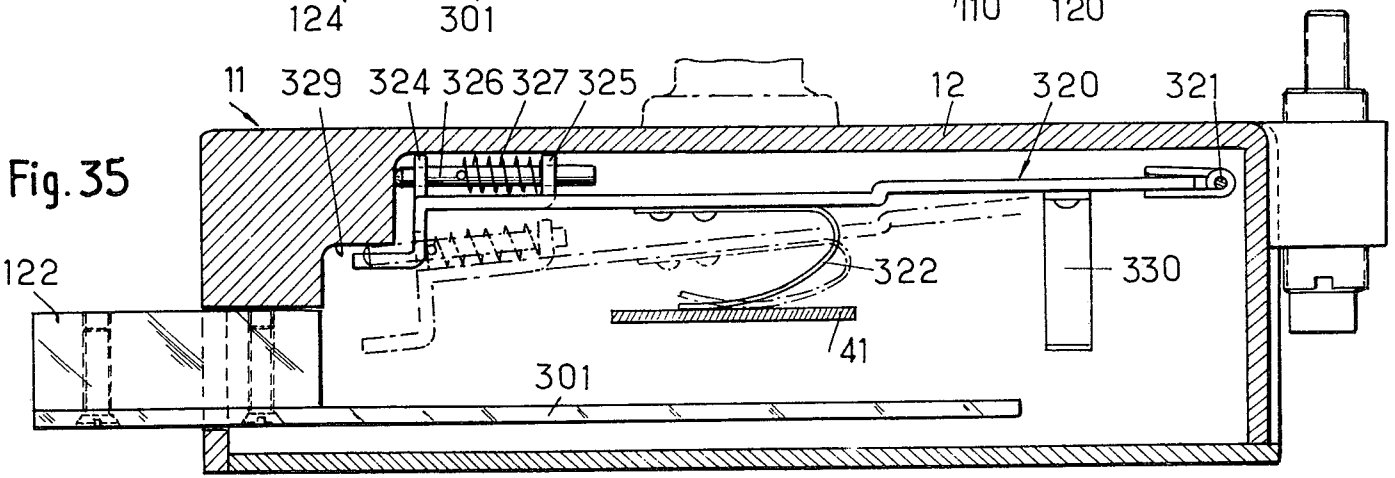
FIG. 35 illustrates the operation of the detector.

For this purpose, a plate 320, FIGS. 27, 28, 29, 33 and 34, cut out in correspondence with the other constituent parts of the lock, is mounted pivoting in case 11, around an axis 321, FIG. 28, parallel to bottom 12, and against the action of a spring leaf 322 bearing against plate 41 which forms the end of the stack of plates 22 in each one of which is housed a wheel 50. Plate 320, comprising the detector, is curved at its end distant from the pivoting axis along a T-square 323 and it carries, through two ears 324 and 325 — projecting on its face facing bottom 12 — a finger 326 on which is hooked a spring 327 which bears against ear 325 and which tends to project the finger in the direction of the free end of the plate. A lug 330, attached on the plate 320 close to the pivoting axis, extends beyond the edge of plate 320 up to the level of the mechanisms of the lock opposite which said plate does not prevail.

In its inoperative condition, plate 320 is substantially parallel to bottom 12 and is maintained in that position through spring 322; finger 326 cooperates with a shoulder 328 of the case and T-square 323, outside the path of the bolt, does not constitute any obstacle to the motion of the latter.

On the contrary, when the lock is the object of a fraudulent opening through attack of the case, and this at the level of the zone on which plate 320 prevails, for example using a mechanical tool, the pressure exerted by said tool onto plate 320 is sufficient to overcome the action of spring 322 and to cause the pivoting of the detector around axis 321. During this pivoting, the end part of finger 326 escapes shoulder 328 of the case under the action of spring 327, finger 326 is brought sufficiently into projection with respect to ear 324 to bear against wall 329 of the shoulder of the case and thus prevent the return of the plate to its initial condition when action of the attacking tool ceases. Under this condition of the detector, which is that shown as a dashed line in FIG. 35, the T-square 323 is on the path of bolt 122, so that it is opposed to an attack of the bolt after the attack of the blocking means.

A similar operation to that described immediately above occurs when attack of the lock is directed not on its blocking means but on its mechanisms, the driving in of the latter controlling the pivoting of plate 320 through pressure on lug 330.

I claim:

1. A combination lock for a safe, chest or strong room door, comprising:

an operating shaft extending through said door and having a lock-actuating end;

means mounted on the exterior of said door for selectively adjusting the translational and rotational positions of said lock-actuating end of said operating shaft;

a plurality of spaced, toothed wheels mounted for rotation on the interior of said door in position to be rotated by said lock-actuating end of said operating shaft;

a corresponding plurality of racks mounted on the interior of said door for engagement with corresponding ones of said toothed wheels for lateral translation in response to rotation thereof;

a corresponding plurality of catch elements mounted on the interior of said door for engagement with corresponding ones of said racks when said toothed wheels have been set in a proper combination by rotation of said operating shaft;

a lock bolt;

means for preventing withdrawal of said lock bolt to an unlocked position;

means connected to said catch elements and operable by rotation of said shaft after said proper combination has been set, for engaging said catch elements with said racks to prevent further movement of said toothed wheels, and for deactuating said means for preventing withdrawal;

means cooperating with said lock-actuating end of said shaft for withdrawing said bolt upon further rotation of said shaft;

means cooperating with said lock-actuating end of said shaft for disengaging said catch elements from said racks upon further rotation of said shaft; and means cooperating with said lock-actuating end of said shaft for displacing said racks to cancel said proper combination.

2. A lock according to claim 1, wherein each wheel is friction mounted in a fixed guiding and maintenance assembly for all of said wheels.

3. A lock according to claim 2, wherein said fixed guiding and maintenance assembly for said wheels comprises a stack of plates maintained at a distance from one another by spacing discs mounted on a support shaft, each of said plates having an elongated slot extending along the greatest part of its length and a circular opening for receiving one of said toothed wheels.

4. A lock according to claim 3, wherein said lock has a case and the plate of said stack most distant from the bottom of said case carries a leaf-spring, the action of which is exerted on the immediately adjacent plate and, progressively, on the remaining plates of said stack and on the wheels housed between said plates, said circular opening of said most distant plate rotatably retaining a control socket for said means for withdrawing said bolt.

5. A lock according to claim 1, wherein said means for selectively adjusting includes a first manipulable selection knob for adjusting the length of said operating shaft and a second manipulable knob for adjusting the angular position of said operating shaft, whereby each of said toothed wheels may be individually moved by rotation of said lock-actuating end of said operating shaft.

6. A lock according to claim 5, wherein each toothed wheel comprises a radial groove and said lock-actuating end of said operating shaft comprises, at the end thereof which is movable in rotation and in translation, a finger resiliently mounted on said shaft and adapted to cooperate with said radial groove to rotate each of said toothed wheels.

7. A lock according to claim 6, wherein said manipulable knobs are connected to said shaft by means for allowing modification of the operating length of said shaft in order to take into account manufacturing tolerances of the thickness of said door.

8. A lock according to claim 6, wherein said lock comprises a case and said operating shaft is enclosed in a tube which is adapted to rotate with said shaft, said tube having a shoulder which bears against said case to prevent translation of said tube along said shaft.

9. A lock according to claim 4, wherein said means for selectively adjusting includes a first manipulable selection knob for adjusting the length of said operating shaft and a second manipulable knob for adjusting the angular position of said operating shaft, whereby each of said toothed wheels may be individually moved by rotation of said lock-actuating end of said operating shaft.

10. A lock according to claim 9, wherein said means for engaging said catch elements comprises:

a rake assembly movably mounted within said case and supporting said catch elements in spaced relation to said racks;

a plate segment mounted for rotation with said control socket;

a stub shaft extending from said plate segment; and a laterally movable cam mounted on said rake assembly in position to be contacted by said stub shaft to move said rake assembly, whereby said catch elements are brought into engagement with said plurality of racks.

11. A lock according to claim 10, wherein said means for displacing said racks comprises a further toothed wheel mounted for rotation on said control socket; a further rack mounted for translation in said case; means attached to said further rack for engaging said plurality of racks to displace them upon movement of said further rack; a further stub shaft extending from said further toothed wheel and an arcuate slot in said plate segment into which said further stub shaft extends.

12. A lock according to claim 10, wherein said means for preventing withdrawal of said lock bolt comprises a resiliently biased blocking dog mounted on said rake assembly in position to prevent movement of said locking bolt until said rake assembly has been moved by said stub shaft and said laterally movable cam.

13. A lock according to claim 10, wherein said means for withdrawing said bolt comprises a groove in said bolt and a further stub shaft extending from said plate segment into said groove to withdraw said bolt as said plate segment is rotated.

14. A lock according to claim 13, further comprising an arcuate rib extending from said plate segment and a correspondingly shaped indentation in said bolt for receiving said arcuate rib to retain said bolt in its withdrawn position.

15. A lock according to claim 10, further comprising means for retaining said rake assembly in the position to which it is moved by said stub shaft until after withdrawal of said bolt has commenced.

16. A lock according to claim 15, wherein said means for retaining comprises a further stub shaft extending from said rake assembly and an arcuate rib extending from said plate segment adjacent said further stub shaft in position to block movement of said rake assembly.

17. A lock according to claim 10, wherein said rake assembly comprises an L-shaped plate mounted for translation in said case and said movable cam is mounted for translation, against the action of resilient means, in a direction perpendicular to that of the translation of said L-shaped plate.

18. A lock according to claim 13, wherein said groove in said bolt comprises:

an arcuate segment having as its center the axis of rotation of said operating shaft when said bolt is extended; and a further segment connected to said arcuate segment and oriented transverse to the direction of displacement of said bolt.

19. A lock according to claim 10, wherein said rake assembly comprises a U-shaped body the legs of which are provided with slots; further comprising: a pair of laterally spaced shafts fixed to the cap and the bottom of said case, said shafts being received in said slots for guiding said rake assembly in translation; at least one spring means connected between said rake assembly and said case for biasing it constantly to a position in which said catch elements are disengaged from said racks and said means for preventing withdrawal of said bolt is operative.

20. A lock according to claim 19, wherein said catch element has a generally rectangular shape having on one edge a rack gear; further comprising a corresponding plurality of blocking strips resiliently mounted in said rake assembly, said blocking strips having teeth for engagement with said rack gear to prevent lateral movement thereof.

21. A lock according to claim 20, further comprising means for disengaging said blocking strips from said catch elements after said catch elements have been engaged with said racks.

22. A lock according to claim 21, wherein said means for disengaging said blocking strips comprises a cam cooperating with said blocking strips, said cam being accessible for rotation only when said catch elements have been engaged with said racks.

23. A lock according to claim 21, wherein said catches are mounted in said rake assembly for lateral translation when said blocking strips are disengaged from said catch elements, whereby said proper combination may be modified or defined.

24. A lock according to claim 23, wherein said catch elements comprise at least one outwardly extending tab; further comprising a plurality of spaced rake plates mounted in said rake assembly, said catch elements being located between said rake plates, said rake plates each having a laterally extending slot for slidably receiving the tab of its corresponding catch element to guide said catch element in lateral movement.

25. A lock according to claim 23, wherein the translational motion of said catch elements in order to define or modify said proper combination, is controlled through displacement of said plurality of racks by rotation of said plurality of toothed wheels.

26. A lock according to claim 11, wherein said further rack is resiliently biased into engagement with said further toothed wheel.

27. A lock according to claim 4, wherein said control socket is slidingly mounted against the action of a spring, further comprising a disc having a radially extending finger adapted to cooperate with radial notches provided in said most-distant plate, the presence of said finger in any one of said notches serving to oppose rotation of said control socket.

28. A lock according to claim 1, wherein said operating shaft is connected to said means for withdrawing said bolt by a disengageable coupling.

29. A lock according to claim 28, wherein said disengageable coupling comprises a spring-biased ball housed in a bore of a socket adapted for rotation by said operating shaft and a bolt driving plate rotatably mounted on said socket, said bolt driving plate having a groove for partially receiving said ball.

30. A lock according to claim 1, further comprising a plate pivotably mounted in the case of the lock; resilient means biasing said plate to an inoperative condition in which it allows the displacement of said lock bolt; and means for positioning said plate to block displacement of said bolt when said lock is tampered with by unauthorized persons.

31. A lock according to claim 30, wherein said means for positioning said plate comprises a spring-biased, non-return finger adapted to cooperate with a shoulder of the lock to prevent movement of said plate to said inoperative position.

32. A lock according to claim 31, wherein said plate comprises a lug extending to the level of said toothed wheels and racks.

* * * * *